US005501647A

United States Patent [19]

Snyder

[11] Patent Number: 5,501,647

[45] Date of Patent: Mar. 26, 1996

[54] FREESTANDING HAND BAR

[76] Inventor: Marnie Snyder, 10877 Bill Point Cir., Bainbridge Island, Wash. 98110

[21] Appl. No.: 303,059

[22] Filed: Sep. 8, 1994

[51] Int. Cl.[6] ..... A63B 1/00

[52] U.S. Cl. ..... 482/38; 482/52; 482/17

[58] Field of Search ..... 482/38, 41, 42, 482/16, 17, 25, 34; 485/52

[56] References Cited

U.S. PATENT DOCUMENTS

| | | | |
|---|---|---|---|
| D. 290,033 | 5/1987 | Policastro . | |
| 2,805,062 | 9/1957 | Holmes | 482/17 |
| 4,258,915 | 3/1981 | Sellge, Jr. et al. | 482/34 |
| 4,986,532 | 1/1991 | DeCloux . | |
| 5,004,224 | 4/1991 | Wang . | |
| 5,033,733 | 7/1991 | Findlay . | |
| 5,058,882 | 10/1991 | Dalebout et al. . | |
| 5,160,302 | 11/1992 | Li . | |
| 5,180,353 | 1/1993 | Snyderman . | |
| 5,190,505 | 3/1993 | Dalebout et al. . | |
| 5,242,340 | 9/1993 | Jerome . | |
| 5,257,963 | 11/1993 | Comfort . | |
| 5,267,922 | 12/1993 | Robinson . | |
| 5,282,776 | 2/1994 | Dalebout | 482/54 |
| 5,334,121 | 8/1994 | McPhilomy | 482/17 |

*Primary Examiner*—Lynne A. Reichard

*Attorney, Agent, or Firm*—Christensen, O'Connor, Johnson & Kindness

[57] ABSTRACT

Structural conduits and fittings are interconnected to form a stand having long, horizontal feet that extend close alongside opposite sides of a standard step aerobics exercise step. Upright legs of the stand have lower portions angled upward and outward from the feet, leading to upper vertical portions or columns that are offset outward from the opposite sides of the step. A horizontal hand bar used for balance is supported by the columns and can be adjusted up or down to accommodate users of different heights. The feet of the device can be swivelled so as to lie substantially in the same plane as the top bar and legs.

6 Claims, 3 Drawing Sheets

FREESTANDING HAND BAR

FIELD OF THE INVENTION

The present invention relates to a horizontal hand bar and support structure for maintaining the bar a desired distance above a supporting surface, suitable for grasping by a user to assist in maintaining balance during exercise.

BACKGROUND OF THE INVENTION

Known benefits of aerobic exercise include cardiovascular fitness, reduced susceptibility to illness, and weight control, in addition to simple recreation for many people. Weight bearing exercises, those in which the body must support itself, also have been shown to increase bone density. The lower body, i.e., the lower trunk and legs, contain the largest muscles in the body, and therefore are those most commonly utilized in aerobic workouts, with or without simultaneous exercise of other muscle groups.

There are many ways to achieve aerobic workouts of muscles of the lower body, one popular manner being "step aerobics" which uses a short, usually portable step. The user repeatedly steps onto and off of the step, sometimes in complicated sequences and open in conjunction with rhythmic music. Complicated patterns of exercise using such a step require considerable practice and balance, particularly as the level of exhaustion increases during a workout.

There are other fields of exercise, notably dance, such as ballet, that require regular practice and balance. In ballet, for example, it is common to use a long horizontal bar permanently attached to a wall for balance, although the ultimate objective is to perform without a balance aid.

SUMMARY OF THE INVENTION

The present invention provides a sturdy, compact, freestanding hand bar that can be conveniently used for balance during a variety of exercise activities, although the freestanding hand bar in accordance with the present invention is designed primarily for use with a standard "step aerobics" exercise step. In the preferred embodiment, structural conduits and fittings are interconnected to form a stand having long horizontal feet that extend close alongside opposite sides of the standard step. Upright legs of the stand have lower portions angled upward and outward from the feet, leading to upper vertical portions or columns that are offset outward from the opposite sides of the step. A horizontal hand bar used for balance is supported by the columns and can be adjusted up or down to accommodate users of different heights. Preferably, the feet of the device can be swiveled so as to lie substantially in the same plane as the top bar and legs, for convenient packaging, stacking and shipment, and for storage by the individual user. The rigidity of the device may be increased by including braces extending from the upper vertical portions of the legs downward into contact with the supporting surface, preferably coaxial with the vertical columns so as not to unduly increase the overall size of the unit when assembled and ready for use.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
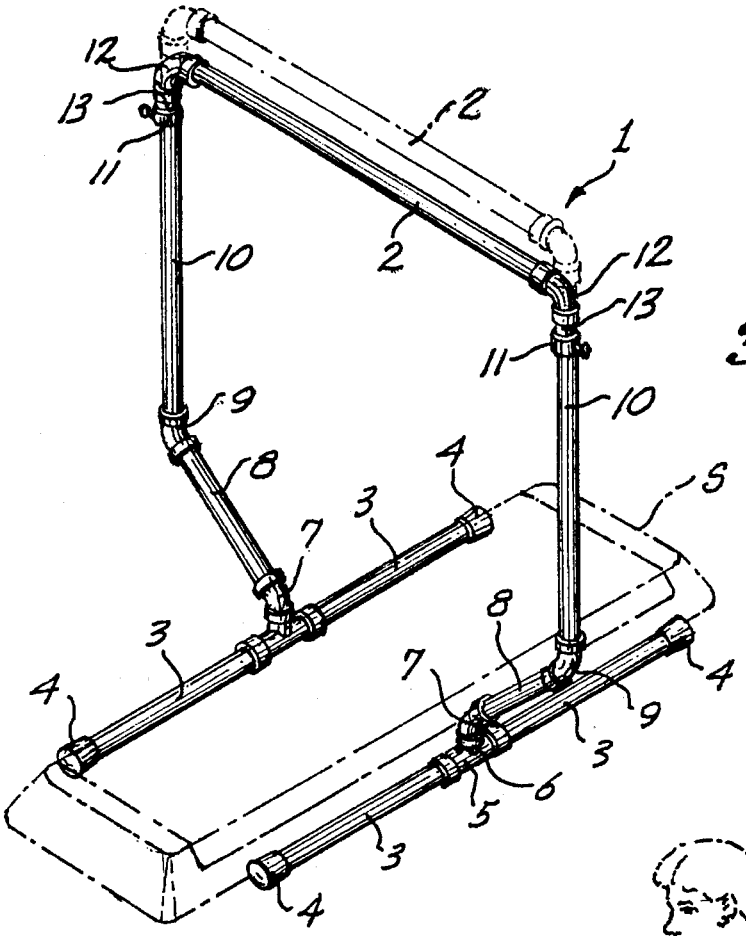
FIG. 1 is a somewhat diagrammatic top perspective of a freestanding hand bar in accordance with the present invention, with a step aerobics exercise step shown in broken lines.
Figure 2:
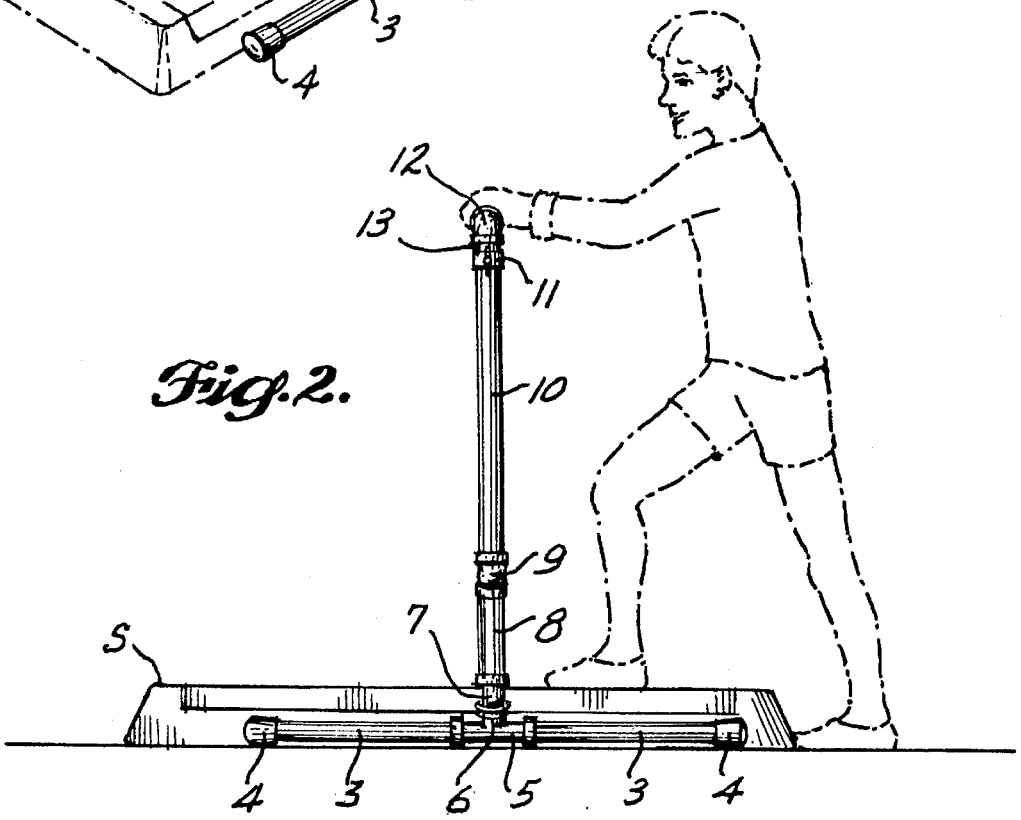
FIG. 2 is a side elevation of the freestanding hand bar of FIG. 1.

With reference to FIG. 1 and FIG. 2, the freestanding hand bar 1 in accordance with the present invention is designed for use with a conventional "step aerobics" exercise step S. In general, hand bar 1 includes a top horizontal member 2 spaced a desired distance above the step for grasping by a user to maintain balance during exercise. The top horizontal member 2 preferably can be adjusted up or down to accommodate users of different heights, and the entire self-supporting unit can be knocked down or swung or folded to compact condition for convenient storage.

The preferred embodiment of the freestanding hand bar 1 is formed of structural plastic conduits and conventional fittings. Beginning at the bottom, the base of the unit includes two coaxial conduits 3 at each side having caps 4 at their free ends. The adjacent ends of the conduits 3 at each side are interconnected by the aligned through joints of a tee 5. Each set of interconnected conduits 3 forms an elongated foot parallel to and offset laterally from the foot at the opposite side. Each tee 5 is arranged with its lateral joint 6 extending vertically, for connection to a 45° elbow 7 leading to a short conduit 8 that extends upward and outward to another 45° elbow 9. The conduits 8 form the lower portions of upright legs at opposite sides of the step. Each upper elbow 9 is oriented such that a longer conduit 10 forming the upper portion or column of the upright leg extends substantially vertically to a top adjustment fitting or collar 11. Collar 11 has a central aperture or bore communicating with the interior of the vertical conduit 10.

Figure 3:
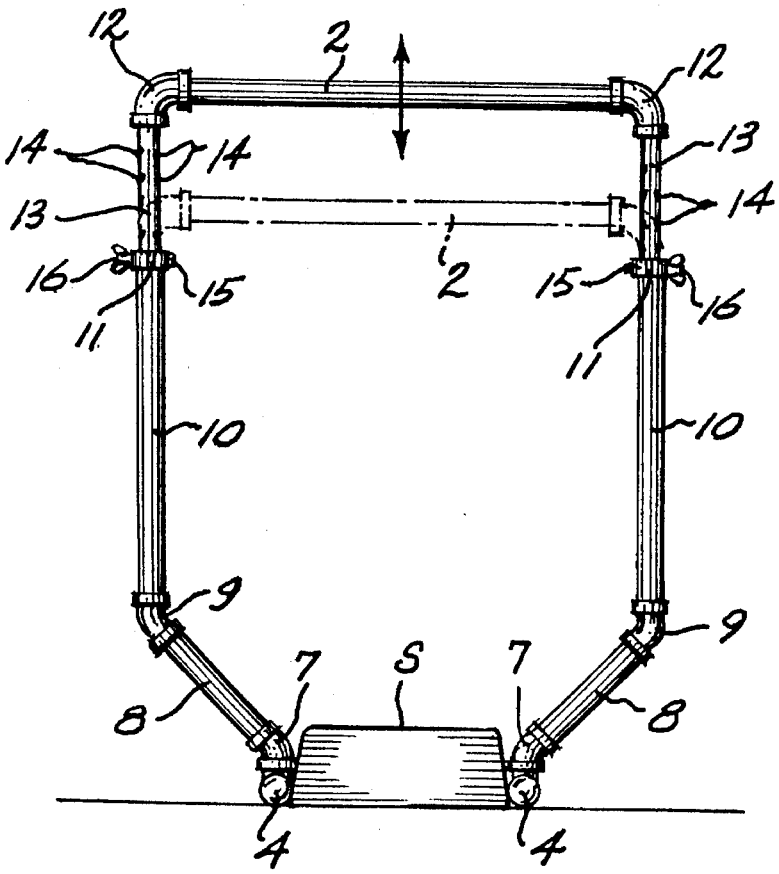
FIG. 3 is an end elevation of the freestanding hand bar of FIG. 1.

The upper horizontal conduit or bar 2 has 90° elbows 12 at its opposite ends. Elbows 12 join the bar to downward-extending adjustment conduits 13 that are sized to telescope snugly yet freely inside the collars 11 and vertical conduits 10. With reference to FIG. 3, the adjustment conduits 13 have vertically spaced sets of registered apertures 14 extending horizontally therethrough for alignment with corresponding holes in the collars 11. The height of the bar 2 above the step 5 can be selected by aligning a desired set of apertures 14 with the holes in the collars. With the desired apertures and holes registered, an adjustment bolt 15 and wing nut 16 are used to maintain the adjustment conduits 13 and columns 10 in the desired telescoped arrangement. In the preferred embodiment, the height of the bar 2 can be adjusted from about 41 inches to about 60 inches from the floor.

Figure 4:
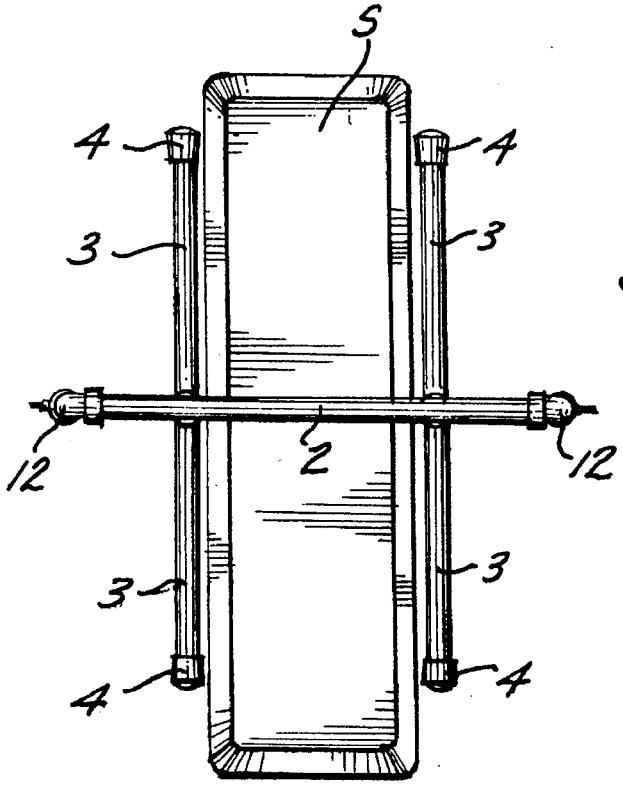
FIG. 4 is a top plan of the freestanding hand bar of FIG. 1.

As seen in FIG. 4, the foot conduits 3 and associated tees 5 extend close alongside the opposite sides of the step S, which helps to assure that the hand bar is stably positioned over the step. Nevertheless, the foot at each side is not as long as the step, i.e., the ends of each foot are spaced inward from the corresponding ends of the step so as not to interfere with an exercising user of the step. In addition, the length of the hand bar is substantially greater than the width of the step, due to the use of the angled lower portions of the support legs. Thus, a user may grasp the top horizontal bar 2 at a location overlying the step or at a location offset outward from either or both sides of the step. In the preferred embodiment, the top bar extends beyond each side of the step at least about 10 inches to 12 inches.

Figure 5:
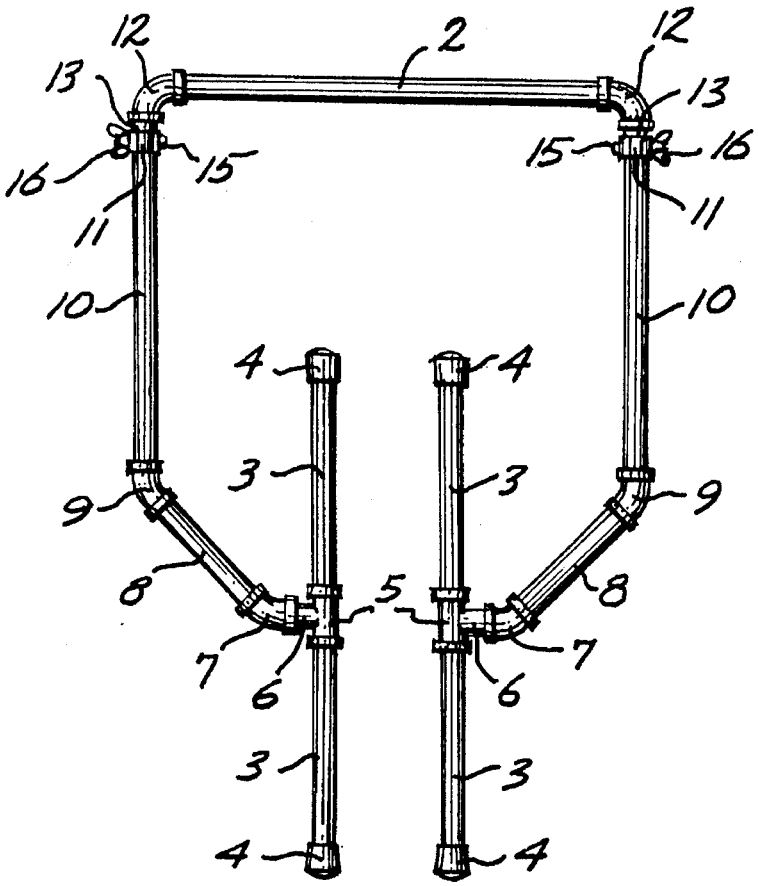
FIG. 5 is an end elevation of the freestanding hand bar of FIG. 1, corresponding to FIG. 3 but with pans in different positions.

In its working condition shown in FIGS. 1 through 4, the device in accordance with the present invention is somewhat bulky and could be difficult to store. Consequently, it is preferred that the lower feet 3 of the device can be swiveled about the axes of the angled lower conduits 8 and about the axes of the lateral joints 6 of the tees 5. This is accomplished by allowing the upper joints of the lower 45° elbows 7 or the lower joints of the upper 45° elbows 9 to rotate relative to the angled conduits 8, and by allowing the tees 5 to rotate about the axes of the lateral joints 6. As seen in FIG. 5, swiveling of the feet about the upper joints of the lower elbows 7 or the lower joints of the upper elbows 9 through angles of 180°, followed by rotating the tees 5 through angles of 90°, moves the feet to parallel positions lying substantially in the same plane as the other conduits of the device, such that the device could be conveniently hung from wall brackets or stored under a bed or in a closet, for example.

Figure 6:
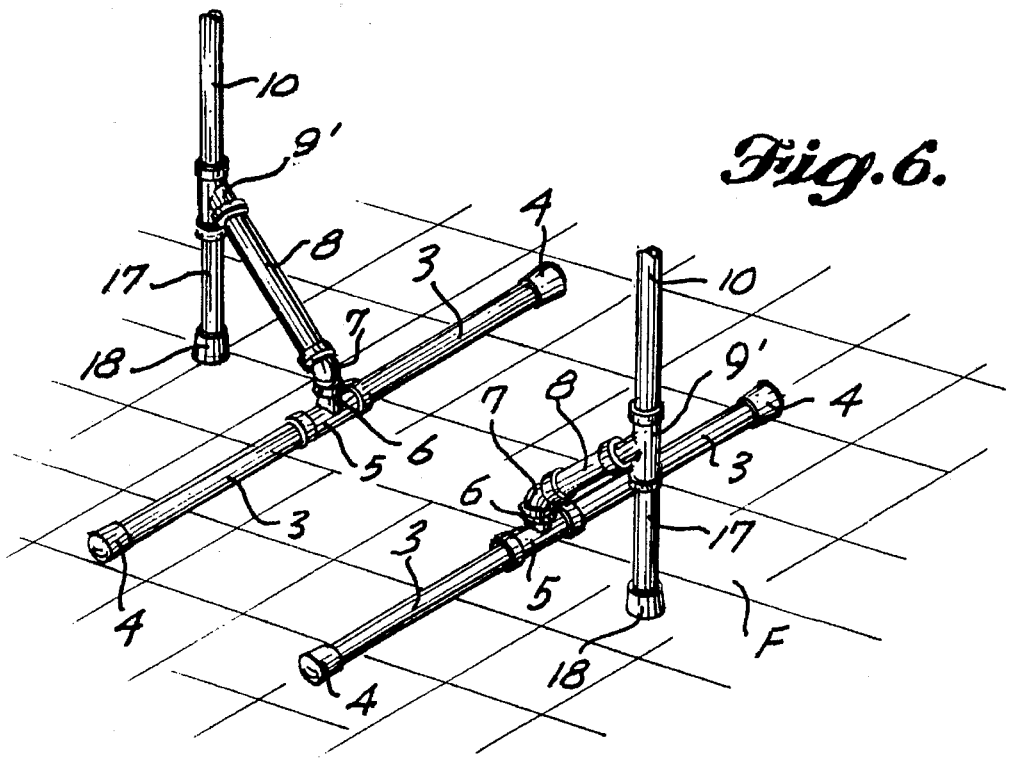
FIG. 6 is a fragmentary perspective of a modified freestanding hand bar in accordance with the present invention.

With reference to FIG. 6, additional rigidity and sturdiness can be provided by including bottom braces 17 that extend vertically downward from upper Y fittings 9', substituted for the elbows 9 of the previously described embodiment, with bottom caps 18 that engage against the supporting surface or floor F. Preferably, braces 15 are coaxial with the upper portions 10 of the support legs so that the overall width of the device is not increased. The caps 16, as well as the caps 4 on the horizontal feet 3, can be rubber or other material having a high coefficient of friction to help to assure that the device does not slip or slide unintentionally during use. Nevertheless, the entire unit is sufficiently lightweight that it may be conveniently lifted and shifted to a desired position. In all other respects the modified embodiment of FIG. 6 is identical to the embodiment previously described, including the angled conduits 8 that branch from the Y fittings 9' and are connected to the lower elbows 7, tees 5 and foot conduits 3 having the end caps 4.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. Exercise apparatus comprising:

a freestanding hand bar for resting on a supporting surface including an upper elongated horizontal member, and a stand connected to said horizontal member for supporting said horizontal member spaced above the supporting surface, said stand including two elongated feet disposed in substantially parallel relationship and spaced apart laterally for resting on the supporting surface and two upright legs connected to said feet, respectively, and extending upward therefrom, each of said legs having an elongated portion angled upward and outward from the corresponding foot to which such leg is connected, said upper horizontal member normally extending transversely of said feet and being of a length substantially greater than the distance between said feet; and a portable step aerobics exercise step having opposite sides positioned between and closely adjacent to said feet.

2. The exercise apparatus defined in claim 1, in which the step has opposite ends, the opposite ends of the feet being spaced inward from the opposite ends of the exercise step.

3. The exercise apparatus defined in claim 1, in which the legs include upper portions offset outward from the opposite sides of the step.

4. A freestanding hand bar for resting on a supporting surface comprising an upper elongated horizontal member, and a stand connected to said horizontal member for supporting said horizontal member spaced above the supporting surface, said stand including two elongated feet disposed in substantially parallel relationship and spaced apart laterally for resting on the supporting surface and two upright legs connected to said feet, respectively, and extending upward therefrom, each of said legs having an elongated portion angled upward and outward from the corresponding foot to which such leg is connected, said upper horizontal member normally extending transversely of said feet and being of a length substantially greater than the distance between said feet, said upright legs including upper vertical portions coupled, respectively, to the angled portions, and said stand including upright braces extending from said upper vertical portions toward the supporting surface.

5. The hand bar defined in claim 4, in which the braces are elongated and approximately coaxial with the upper vertical portions of the legs.

6. The hand bar defined in claim 4, in which the angled portions of the legs are coupled, respectively, to approximately the centers of the elongated feet.

* * * * *